United States Patent [19]

Grose et al.

[11] Patent Number: 4,750,001

[45] Date of Patent: Jun. 7, 1988

[54] PORTABLE ROLL-OUT ANTENNA SYSTEM AND METHOD

[75] Inventors: Brian L. Grose, Provo; Craig M. Huntsman, West Valley City, both of Utah

[73] Assignee: Eyring Research Institute, Inc., Provo, Utah

[21] Appl. No.: 902,483

[22] Filed: Sep. 2, 1986

[51] Int. Cl.[4] ..... H01Q 1/12
[52] U.S. Cl. ..... 343/877
[58] Field of Search ..... 343/877

[56] References Cited

U.S. PATENT DOCUMENTS

| | | | |
|---|---|---|---|
| 1,894,244 | 1/1933 | Ruble | 343/877 |
| 2,161,044 | 6/1939 | Heintz et al. | 173/367 |
| 2,574,733 | 11/1951 | Ehrlich | 250/33 |
| 2,834,012 | 5/1958 | Allen | 343/723 |
| 2,842,768 | 7/1958 | Halperin | 343/877 |
| 3,400,402 | 9/1968 | Gallagher et al. | 343/723 |
| 3,577,148 | 5/1971 | Holzchuh et al. | 343/821 |

*Primary Examiner*—William L. Sikes
*Assistant Examiner*—Robert E. Wise
*Attorney, Agent, or Firm*—Workman, Nydegger & Jensen

[57] ABSTRACT

A novel broadband antenna system which is both portable and easily deployed. The system comprises a power splitter, one or more element feed units, and one or more conductive antenna cables, each cable being wound around a reel.

Each reel is releasably secured on an end of an element feed unit. Each element feed unit comprises an impedance matching network, and the element feed units also include a novel clip. The clip functions both to releasably retain a reel on an end of the element feed unit during transportation and storage and to electrically and mechanically connect a conductive antenna cable to the element feed unit when the antenna system is being used.

In use, the element feed units are connected to the power splitter, and the power splitter is connected to a transmitter/receiver device. One or more conductive antenna cables are then connected to the element feed units using the novel clips. The cables can be placed directly on the ground or can, alternatively, be supported along at least a portion of their length above the ground by stakes.

21 Claims, 6 Drawing Sheets

PORTABLE ROLL-OUT ANTENNA SYSTEM AND METHOD

BACKGROUND

1. The Field of the Invention

This invention relates to antennas and, more particularly, to novel apparatus and methods for providing a broadband roll-out antenna system which is portable, resistant to destruction, and easily deployed.

2. The Prior Art

The design and manufacture of antennas for transmitting and receiving electromagnetic signals has been the subject of ongoing research for many years. Today, a multitude of different antennas are available for a wide variety of applications. In choosing among these many different antenna designs, a number of different factors must be considered.

It is first necessary to consider whether the antenna will transmit and receive electromagnetic signals which have the appropriate frequency. To a large extent, this will depend upon the specific needs of the antenna user and upon the particular conditions under which the antenna will be operated.

For example, television crews which are filming on location, or military troops may desire to transmit signals to a station which is not in their line of sight but which is less than about 300 miles away. In such cases, it will generally be necessary to transmit and receive signals having a frequency within the range of from approximately 2 to approximately 16 megahertz (MHz). The electromagnetic signals must be launched at "near vertical incidence" (that is, nearly vertically upward), in order to be reflected off the ionosphere back to the receiving station at this short distance.

When transmitting and receiving electromagnetic signals over a distance greater than approximately 300 miles, signals of higher frequency will often be required. In addition, the antenna employed must be capable of launching the electromagnetic signals at an angle which is near the horizon.

It may not always be possible to reflect electromagnetic signals from the ionosphere between the transmitting and receiving stations. Such is, for example, sometimes the case during nighttime transmissions. A nuclear attack would likely disturb the ionosphere and make it difficult to use. In such circumstances, electromagnetic signals could be reflected between stations from the trails of meteors which strike the earth's atmosphere. Reflecting signals off meteor trails often requires the use of electromagnetic signals within the range of from approximately 30 to 70 MHz.

While operation of an antenna at a single frequency, or over a relatively narrow range of frequencies, may be acceptable for some applications, broadband operation is often desirable. For example, microprocessors are often used in connection with communication systems to select the best frequency and the best available path for transmission at any given moment. However, if the antenna must first be tuned to operate at a different frequency before the transmission can be made, the response of the system is often much too slow to take full advantage of the microprocessor's capabilities. The use of an antenna capable of broadband operation, on the other hand, would allow the communications system to immediately transmit with the optimum frequency and path selected by the microprocessor.

Similarly, in military applications, messages are generally transmitted at several different frequencies, and the signal frequency is often changed in some manner during the transmission. In this way, it becomes much more difficult for unauthorized personnel to intercept the transmitted message, and hostile groups or forces are less likely to be able to jam or distort the transmitted message. In these military applications, therefore, it is critical that the communication system be able to transmit and receive over a broad band of frequencies.

The selection of an appropriate antenna also depends upon whether the communication system must be portable. Portable transmitters and receivers have become indispensable in a wide variety of governmental and commercial applications. For example, portable radio equipment has become an essential tool to police, rescue, and military organizations and to television and radio crews. Also, in military applications, it is highly desirable to be able to move rapidly from one radio transmitting site to another as quickly as possible, and to be able to easily camouflage the antenna. In other applications, it is important to choose an antenna which is less vulnerable to destruction due to shock from a blast, severe weather conditions or other similar circumstances.

Despite the large number of different antenna designs which are currently available, the prior art antenna designs are generally somewhat inflexible. For example, many prior art communication systems employ large antennas which extend high above the earth's surface in order to effectively transmit and/or receive the desired electromagnetic signals. Such antennas are commonly referred to as "aerial" antennas. Typical aerial antennas may, for example, be secured several hundred feet above the earth's surface to the top of a high tower or building; and such antennas are also commonly supported by numerous guy wires which provide the antenna with additional structural stability. It is also quite common to install aerial antennas, together with their supporting towers and guy wires, on the slopes of relatively high mountains. By placing the antennas upon such towers and/or mountains, the range and effectiveness of the antennas can be significantly increased.

Although conventional aerial antennas are generally quite effective and may be constructed so as to operate very efficiently in both transmitting and receiving the desired electromagnetic signals, such antennas are considered "soft" for security purposes. Even though a powerful explosion may be centered some distance away from the above-described aerial antennas, the resulting shockwaves will likely damage or destroy such antennas, thereby rendering the associated communication systems either totally or partially inoperative. Furthermore, aerial antennas which transmit or receive high frequency electromagnetic signals are very susceptible to the adverse effects of the above-mentioned electromagnetic pulse radiation.

Most prior art antenna systems are also inefficient in transmission and reception, except over a relatively narrow band of electromagnetic signal frequencies. Significantly, if such systems are used in connection with military communications which are being transmitted over a number of different frequencies, the antenna system may not be able to efficiently transmit or receive portions of a message. Only those portions of the message which are transmitted at a frequency which is within the narrow operating band of frequencies for which the antenna system was designed can be efficiently transmitted or received. Portions of the message which are transmitted at other frequencies may be either weak or lost entirely.

Some attempts have been made to adapt prior art antenna systems for operation over a broad band of signal frequencies. Such attempts are typically quite cumbersome, however, requiring complex tuning mechanisms or other system adjustments. As a result, few prior art antenna systems have been able to provide the broadband operation characteristics which are needed for many applications.

The prior art antenna systems have also often been very difficult to move from site to site. Frequently, antennas which are reasonably portable are generally less efficient than desirable. Thus, an antenna designer was faced with the choice of designing a very portable antenna or an efficient antenna. Alternatively, in some cases portability could be achieved but the antenna became extremely complex in its construction and deployment, or cumbersome in size and weight. For example, one approach taken in the prior art to provide an efficient portable antenna is to modify the design of a rigid-element antenna intended for use as a permanently installed antenna. This modification generally allowed the antenna to be disassembled for transportation from site to site. Use of rigid elements in a portable antenna also allows the antenna to be of a design similar to a permanently installed fixed-base antenna. Further, the use of a rigid-element antenna generally provides an antenna whose radiation pattern, directivity and standing wave ratio at a particular frequency, is independent of the physical surroundings in which it is operated. There are, however, several problems which accompany the use of rigid-element antennas as portable antennas.

The first of these problems is that the assembly and disassembly of a rigid-element antenna generally takes a significant amount of time and can also be quite complex. The fact that the antenna takes an extended length of time to assemble or deploy reduces its usefulness with a portable transmitter/receiver.

Second, rigid-element antennas, even when disassembled, are often both bulky and heavy, making them difficult to transport. Alternatively, if the weight of the rigid-element antenna is lessened to ease transportation difficulties, the rigid elements of the antenna generally become more fragile requiring greater care in assembly, disassembly, transportation, and use.

Also, a rigid-element antenna generally requires suspension above the ground for proper operation. This is usually done by mounting the antenna on a tall mast. The requirement of a mast further increases the difficulty of transporting and assembling the antenna system, in addition to providing a very conspicuous marking as to the location of the transmitter/receiver. Such conspicuousness can be a great disadvantage in a military operation.

Other types of portable prior art antennas include single-element antennas often consisting of a single vertical element configured in a flexible "whip" manner. A single-element antenna provides some of the required portability in that they are generally easy to transport and assemble. Such antennas are, however, often inefficient transmitters and receivers of electromagnetic signals.

At high and medium frequencies it becomes especially difficult to design an efficient antenna that is still reasonably portable. This can be appreciated by considering, for example, the necessary length of a quarter-wave whip-radiating element that is to be operated at 10 MHz. The shortest length of a whip antenna element which will resonate at a given frequency must be approximately equal to one-quarter the wave length at that frequency. A 10 MHz signal was a wave length of approximately 30 meters. Thus, a quarter-wave antenna must be approximately 7.5 meters in length. It can be appreciated that a rigid antenna element 7.5 meters in length can present considerable difficulties when transported. These problems are compounded when designing a portable antenna for use at frequencies lower than 10 MHz, since the wave length at such frequencies is even longer.

BRIEF SUMMARY AND OBJECTS OF THE INVENTION

In view of the foregoing, it is a primary object of the present invention to provide an apparatus and method for providing an antenna system which can readily be operated over a wide band of electromagnetic signal frequencies.

It is also an object of the present invention to provide a broadband antenna system which can launch electromagnetic signals at angles of near vertical incidence so as to transmit and receive signals over relatively short distances.

It is a further object of the present invention to provide a broadband antennas system which is portable, rugged, and easily deployed.

Additionally, it is an object of the present invention to provide a portable, broadband antenna system which is reasonably durable and less vulnerable to destruction.

It is a still further object of the present invention to provide a portable, broadband antenna system which can be effectively deployed with little prior training.

Consistent with the foregoing objects, the present invention is directed to a novel broadband antenna system which is both portable and easily deployed. The system comprises a power splitter, one or more element feed units, and one or more conductive antenna cables, each cable being wound around a reel.

Each reel is releasably maintained on an end of an element feed unit. Each element feed unit comprises an impedance matching network, and the element feed units also include a novel clip. The clip functions both to releasably retain a reel on an end of the element feed unit during transportation and storage and to electrically and mechanically connect a conductive antenna cable to the element feed unit when the antenna system is being used.

In use, the element feed units are connected to the power splitter, and the power splitter is connected to a transmitter/receiver device. One or more conductive cables are then connected to the element feed units using the novel clips. The cables can be placed directly on the ground or can, alternatively, be supported along at least a portion of their length above the ground by stakes. Significantly, the antenna system of the present invention can be operated over a broad band (e.g., at least two or more octaves) of frequencies selected from the LF to VHF range (e.g., 0.01–150 MHz)

These and other objects and features of the present invention will become more fully apparent from the following description and appended claims, taken in conjunction with the accompanying drawings.

DETAILED DESCRIPTION OF THE PREFERRED EMBODIMENTS

It will be readily appreciated that the components of the present invention, as generally described and illustrated in the figures herein, could be arranged and designed in a wide variety of different configurations. Thus, the following more detailed description of the embodiment of the system and method of the present invention, as represented in FIGS. 1 through 13, is not intended to limit the scope of the invention, as claimed, but it is merely representative of one presently preferred embodiment of the invention.

The presently preferred embodiments of the invention will be best understood by reference to the drawings, wherein like parts are designated with like numerals throughout.

1. Antenna System Structure

Figure 1:
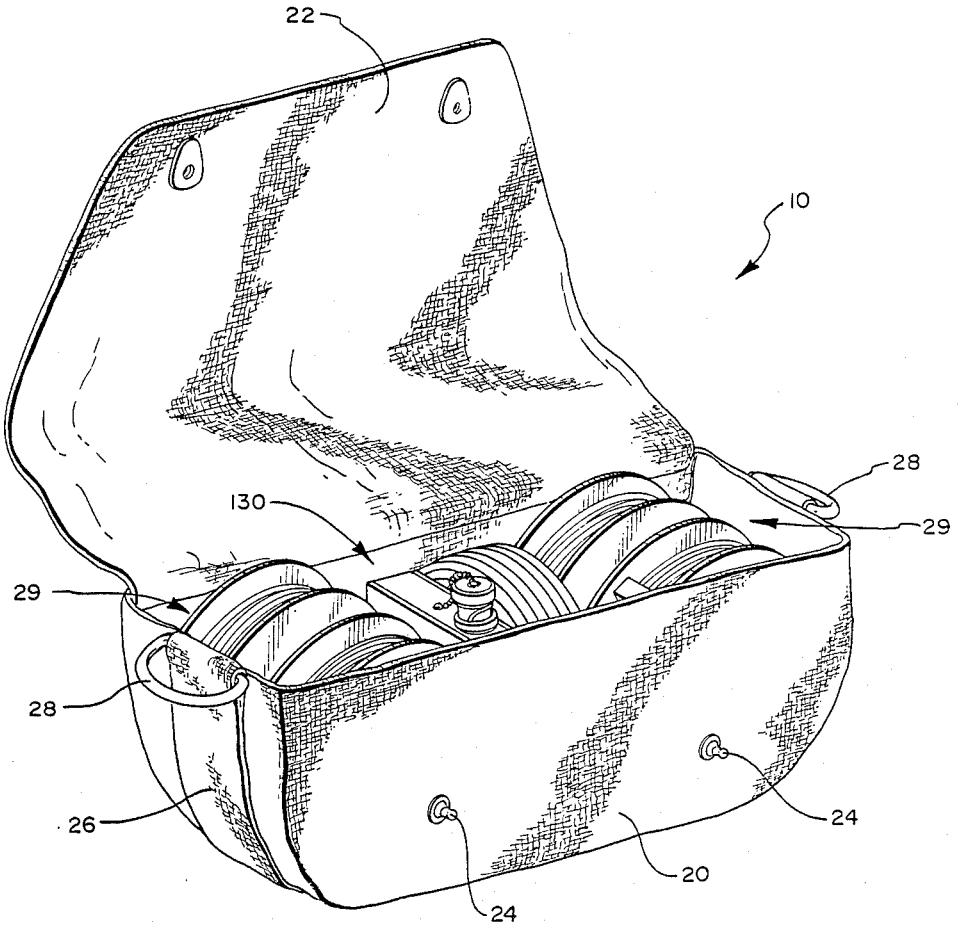
FIG. 1 is a perspective view of one presently preferred embodiment of the portable broadband antenna system of the present invention stowed in its storage pouch.

The antenna system of the present invention, designated generally at 10, is illustrated in its entirety in FIG. 1 as it may be stored and transported. As shown, antenna system 10 comprises two element feed units 29 and a power splitter 130. These components are contained within a bag 20 which also contains cables for connecting antenna system 10 to a transmitter/receiver device.

Bag 20 may be formed of any suitable material such as, for example, a canvas material. As depicted in FIG. 1, bag 20 includes a flap 22 which may be secured by means of snaps 24. A length of webbing 26 extends underneath bag 20 to provide added support and strength, and rings 28 are provided on the sides of bag 20 for use in carrying bag 20. Additionally, bag 20 could also include separate pockets (not shown) to receive each of the component parts of antenna system 10.

Advantageously, antenna system 10 is constructed so as to be both compact and light-weight. Antenna system 10 can, for example, be constructed in many cases so as to weigh only approximately five pounds. Bag 20 can thus be easily secured to an individual and used to transport antenna system 10 from one place to another.

Figure 2:
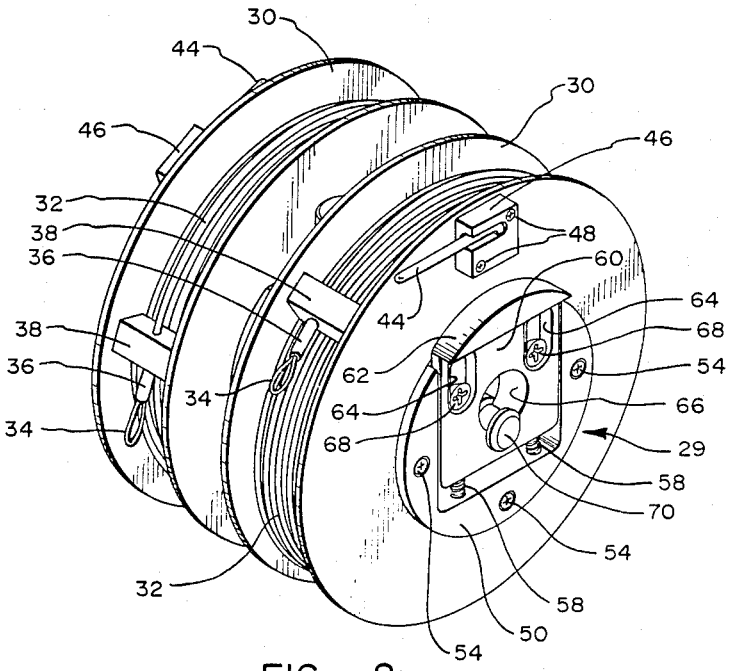
FIG. 2 is a perspective view of one presently preferred embodiment of an element feed unit of the antenna system of the present invention with two reels attached.

As illustrated in FIG. 2, element feed units 29 of antenna system 10 are designed so as to receive two reels 30. Reels 30 may be formed of any suitable material, such as, for example, anodized aluminum.

Each reel 30 has a conductive antenna cable 32 wound thereon. Cable 32 may be formed of any suitable conductive material such as, for example, stranded stainless steel, copper plated stranded stainless steel, or phosphor bronze. The diameter of cable 30 can be quite small such as, for example, 0.062 inches (1.57 millimeters). Further, although cable 32 can have any suitable length, it is presently preferred that cable 32 be approximately 150 feet (45.72 meters) long.

Cable 32 is insulated with a suitable insulation material. Cable 32 may, for example, be insulated with a nylon sheath or with a polyvinyl chloride jacket. Alternatively, in order to withstand extreme temperatures and other rugged conditions, cable 32 may be insulated with a Teflon® brand material. The thickness of the insulation covering cable 32 can be any suitable thickness, such as, for example, 0.015 inches (0.38 millimeters).

The outward end 34 of cable 32 is formed as a loop, as shown. For reasons which will become apparent from the discussion which follows, loop 34 of cable 32 has been stripped of its insulation. Loop 34 is secured by means of a crimped sleeve 36.

A cable retainer 38 is provided adjacent loop 34 of cable 32. Cable retainer 38 may, for example, be formed of a rubber material. Cable retainer 38 is large enough so that it can be forced into reel 30 to prevent cable 32 from coming off of reel 30 during transport.

The end of each cable 32 opposite loop 34 is preferably secured to reel 30 in some manner. For example, such end of cable 32 may be provided with an eyelet, and cable 32 can be attached to reel 30 by means of a securing screw.

Figure 10:
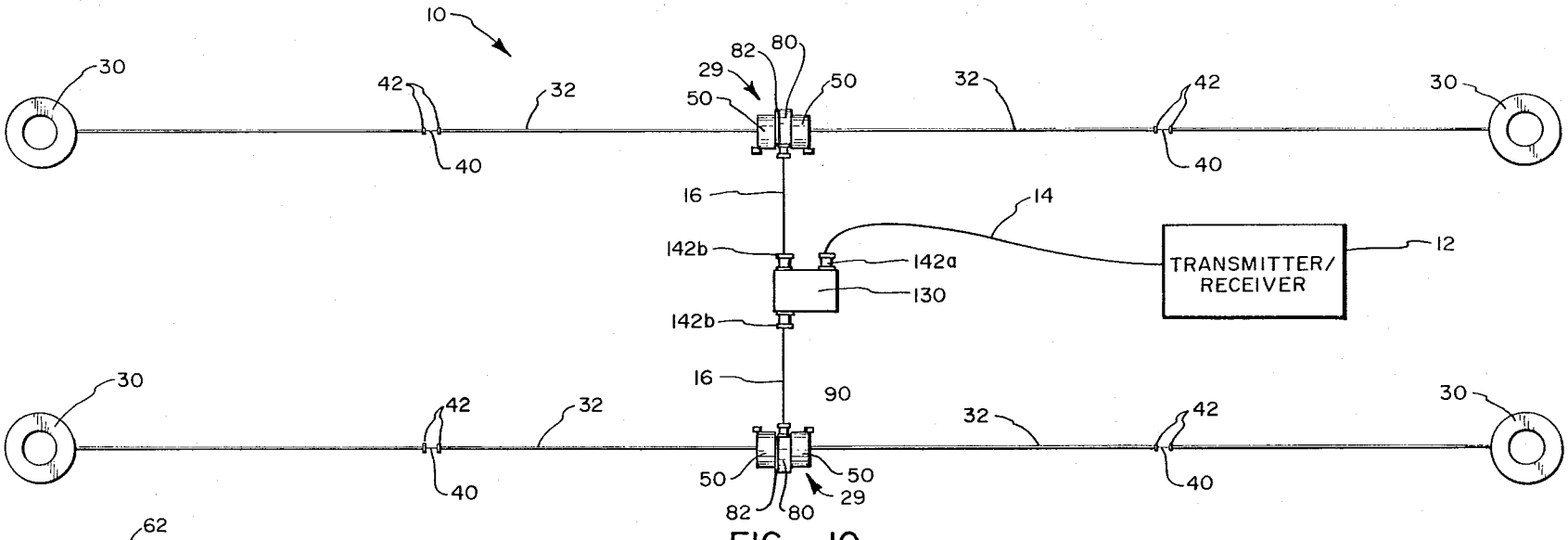
FIG. 10 is a top plan view of one presently preferred deployment configuration for the portable broadband antenna system of the present invention.

As illustrated in FIG. 10, a small center portion 40 of each cable 32 is stripped of insulation material. In order to assist in locating such center portion 40, a pair of sleeves 42 may be secured on either side of center portion 40. The purpose of center portion 40 of cable 32 is set forth below.

Each reel 30 is provided with an L-shaped handle 44 which is maintained within a handle block 46. Handle block 46 is secured to reel 30 by means of screws 48, and handle block 46 may contain a piece of rubber material or some other suitable material to prevent handle 44 from rattling within handle block 46 during transport.

As explained further below, cables 32 are removed from reels 30 during operation of antenna system 10. When antenna system 10 is thereafter to be transported, reels 30 can be placed upon an element feed unit 29, as depicted in FIG. 2, and secured thereon as a compact, unitary assembly. Significantly, reels 30 are free to rotate upon element feed unit 29, and handles 44 can thus be extended and used to rotate reels 30 so as to wind cables 32 thereon.

Figure 3:
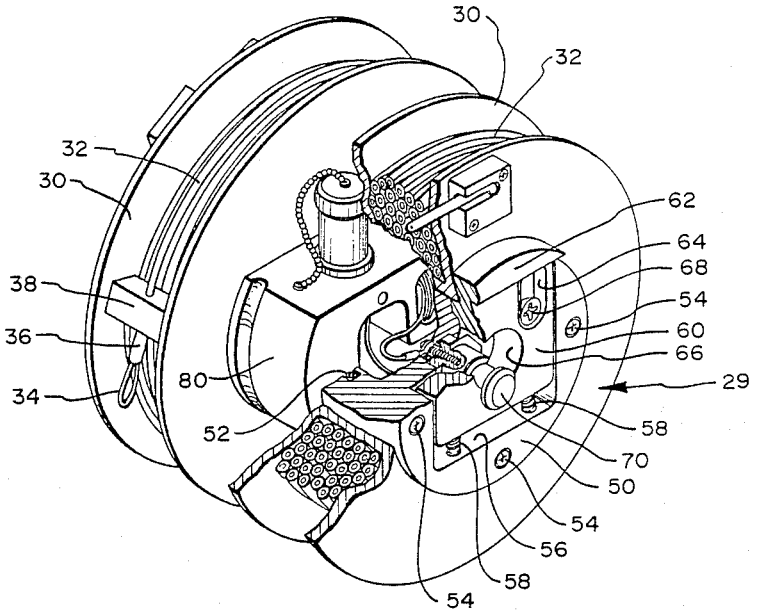
FIG. 3 is a perspective view of the embodiment of the element feed unit illustrated in FIG. 2 with parts broken away to reveal the internal construction.

As shown best in FIG. 3, each element feed unit 29 comprises an end cap 50 and a center hub 80. Center hub 80 of element feed unit 29 includes an impedance matching network. End cap 50 is configured so as both to releasbly retain a reel 30 on element feed unit 29 and to facilitate connecting cables 32 to the impedance matching network of center hub 80.

End cap 50 of element feed unit 29 is formed of a nonconductive material, such as, for example, Delrin® brand plastic. End cap 50 is secured to center hub 80 by means of screws 54. Importantly, an O-ring 52 is positioned in a groove in end cap 50 so as to form a watertight seal between end cap 50 and center hub 80.

The coefficient of thermal expansion of end cap 50 may be significantly different from the coefficient of thermal expansion of center hub 80. Therefore, it is presently preferred that screws 54 be provided with split-spring lock washers which are tightened so as to maintain constant tension on O-ring 52 and thereby continuously preserve the watertight seal between end cap 50 and center hub 80.

The outer end of end cap 50 has a recess 56 formed therein which slidably receives a retaining clip 60. Clip 60 may, for example, be formed of the same material as end cap 50. Clip 60 has two slots 64 formed therein (see FIG. 2), and clip 60 is retained in recess 56 of end cap 50 by means of screws 68. Optionally, screws 68 may be provided with suitable bushings to facilitate the sliding of clip 60 along slots 64.

Clip 60 is outwardly biased by means of springs 58 which extend between clip 60 and recess 56 of end cap 50. Thus, the end 62 of clip 60 will normally extend outward so as to form a shoulder that serves to retain a reel 30 on end cap 50. To remove reel 30, end 62 of clip 60 is pushed inwardly until reel 30 is able to slide past end 62 of clip 60.

Clip 60 is also provided with a notched opening 66 which engages a post 70. The engagement of post 70 by clip 60 facilitates connecting cables 30 to element feed unit 29, as will become more readily apparent from the discussion which follows.

Figure 3A:
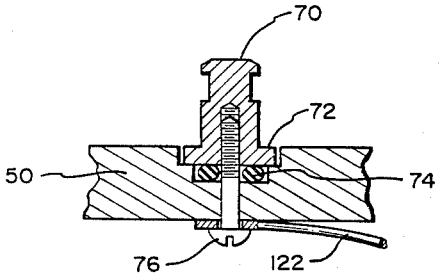
FIG. 3A is a cross-sectional view of the post of the end cap of FIG. 3 illustrating the manner in which the post is secured within the end cap.

As shown in FIG. 3A, post 70 of end cap 50 is secured within a countersunk bore in end cap 50. Preferably, an O-ring 74 is positioned between the base 72 of post 70 and end cap 50 so as to provide a watertight seal between post 70 and end cap 50.

The electrical circuitry of center hub 80 is connected to post 70 of end cap 50 by means of a wire 122. For example, as depicted in FIG. 3A, the base 72 of post 70 may be drilled and tapped so as to receive a screw 76, and wire 122 may be secured to post 70 by means of screw 76.

Post 70 may be formed of any suitable material, such as, for example, stainless steel. Significantly, post 70 provides isolation from electrical ground and connects cables 32 of antenna system 10 to the impedance matching network in center hub 80.

Figure 4:
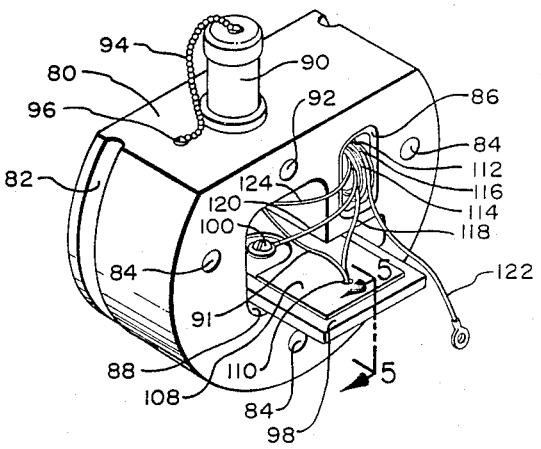
FIG. 4 is a perspective view of one presently preferred embodiment of the center hub of the element feed unit of the antenna system of the present invention.

Center hub 80 of element feed unit 29 is shown in its entirety in FIG. 4. Hub 80 is a substantially cylindrical member which is preferably formed of a material which is a good thermal conductor. Thus, for example, hub 80 may be formed of anodized aluminum.

Figure 5:
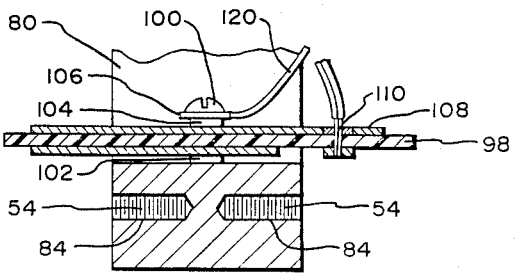
FIG. 5 is a vertical cross-sectional view of the embodiment of the center hub of FIG. 4 taken along lines 5—5 of FIG. 4.

Hub 80 is drilled and tapped on each face with holes 84 which then receive the screws 54 which secure end caps 50 to hub 80 (see FIG. 5). In addition, hub 80 has two milled channels 86 and 88 which receive the electrical circuitry of hub 80. Hub 80 is also provided with a circumferential groove 82 which will assist in deploying antenna system 10, as explained more fully below.

Hub 80 is provided with a connector 90 which is secured in place by a set screw 92. Connector 90 includes a dust cap which is firmly secured to hub 80 by means of a chain 94 and a securing stud 96.

A printed circuit (PC) board 98 is secured within channel 88 of hub 80. PC board 98 is a double-sided copper-clad board which is secured within hub 80 by means of a screw 100.

As illustrated in FIG. 5, PC board 98 rests upon a lock washer 102 which directly abuts the inner surface of groove 88 of hub 80. A fiber washer 104 is provided on top of PC board 98, and a solder lug 106 is provided immediately adjacent the head of screw 100. Thus, screw 100 is in direct electrical contact with both hub 80 and the bottom side of PC board 98. At the same time, screw 100 is not electrically connected to the top side of PC board 98 since the copper laminate 108 on PC board 98 has been etched away immediately around screw 100, as depicted in FIG. 4.

Channel 86 in hub 80 is provided with a high temperature ferrite core 112. Ferrite core 112 may, for example, comprise ferrite granules which are embedded in a polyester or epoxy binder. Suitable ferrite cores are available on the market, such as, for example, Stock No. 57-9433 of Stackpole and Stock No. BN-61-202 of Amidon.

Ferrite core 112 may be retained within channel 86 of hub 80 in any suitable manner. For example, ferrite core 112 may be maintained in channel 86 by means of a spring (not shown) which keeps ferrite core 112 in constant tension against the interior surface of channel 86. In order to maximize heat transfer and dissipation between ferrite core 112 and hub 80, ferrite core 112 is also preferably coated with a heatsink compound, such as, for example, the heatsink compound currently available from Thermalloy, Inc. as Stock No. 351.

Figure 4A:
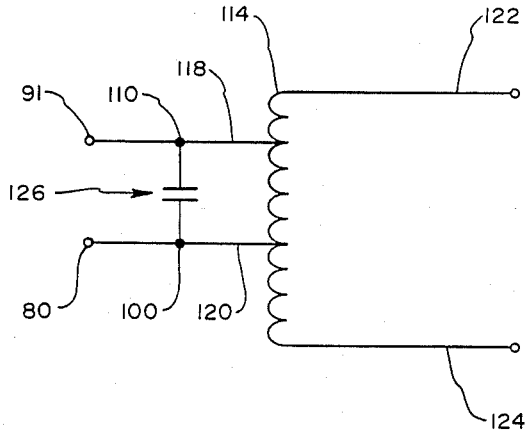
FIG. 4A is an electrical schematic diagram illustrating one presently preferred embodiment of the electrical circuitry contained in the center hub depicted in FIG. 4.

Ferrite core 112 is internally wound with wire 114. After being wound, pegs may be inserted into holes 116 of ferrite core 112 to help retain wire 114 in place. The way in which the wire winding 114 of ferrite core 112 is connected to PC board 98 is illustrated schematically in FIG. 4A.

As shown, connector 90 is connected by wire 91 through point 110 of PC board 98 and wire 118 to winding 114 of ferrite core 112. Hub 80 is similarly connected through screw 100 and wire 120 to winding 114. The ends 122 and 124 of winding 114 are then connected to posts 70 of end caps 50, as depicted in FIG. 3A. From FIGS. 4 and 4A, it can be appreciated that PC board 98 functions as a capacitor 126 which provides needed capacitive compensation to the impedance matching network, of hub 80.

Figure 12:
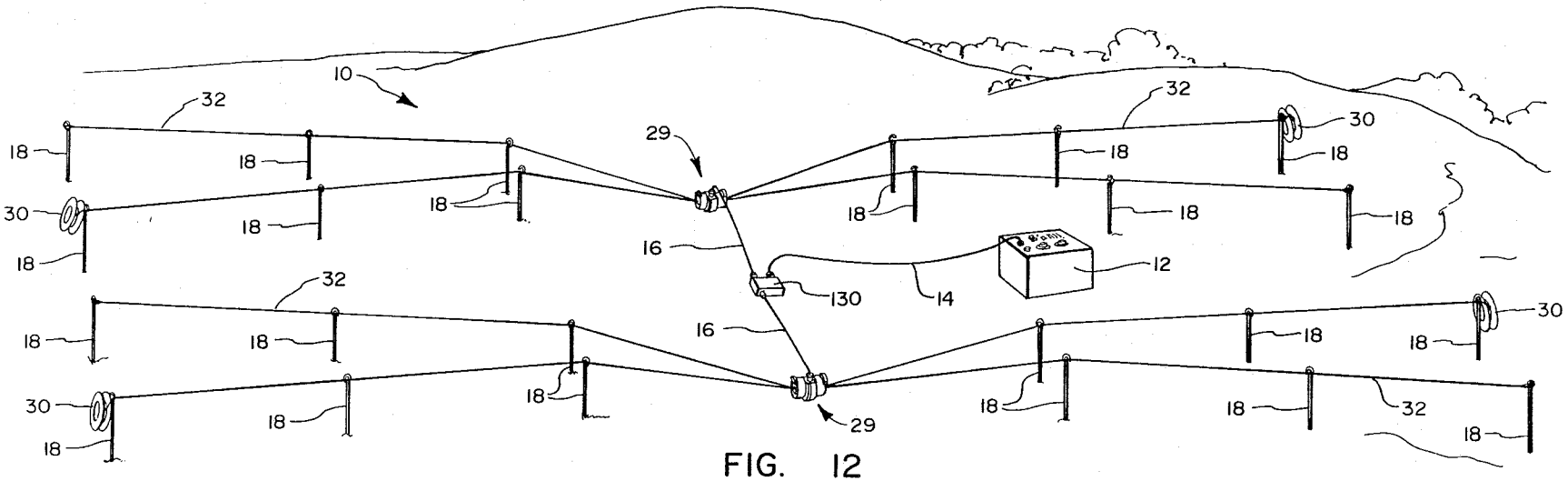
FIG. 12 is a perspective view of a second presently preferred deployment configuration for the portable broadband antenna system of the present invention.
Figure 13:
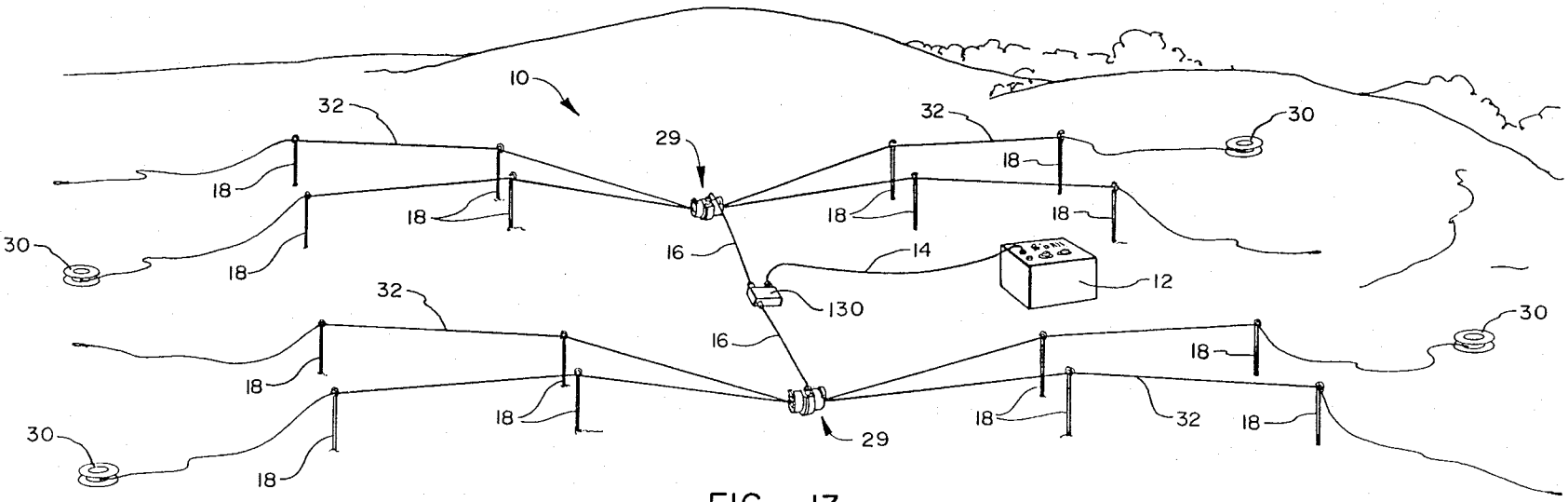
FIG. 13 is a perspective view of a third presently preferred deployment configuration for the portable broadband antenna system of the present invention.

The above outlined circuitry of hub 80 is configured as a balun or RF transformer and matches the impedance of the cables 32 to the impedance of the transmission line connecting the transmitter/receiver device. When placed directly on the ground or deployed as illustrated in FIGS. 12 or 13, the impedance stepdown ratio of the balun should preferably be within the range of from approximately 1:4 to approximately 1:12, with the presently preferred ratio being approximately 1:9. Significantly, the circuitry of hub 80 provides an appropriate impedance match which is relatively independent of temperature over a broad range of temperatures ranging as high as 100° C.

The power splitter 130 of antenna system 10 is illustrated in FIGS. 6–9. As shown, power splitter 130 comprises an enclosure 132 having a top 134 and a bottom 136. Enclosure 132, together with its top 134 and bottom 136, can be formed of any suitable material, such as, for example, anodized aluminum.

Top 134 and bottom 136 are secured to enclosure 132 by means of screws 138. In addition, as illustrated in FIG. 9, a layer of heat conducting epoxy 140 is preferably provided between top 134 and bottom 136 and enclosure 132 in order to seal enclosure 132 and provide for effective heat transfer between top 134, bottom 136, and enclosure 132.

Power splitter 130 is provided with three connectors 142 which are each secured to enclosure 132. Connectors 142 include a dust cap which is secured to enclosure 132 by means of a chain 144 and a securing stud 146. As will become more readily apparent from the discussion which follows, connector **142*a* is intended to be connected to a transmitter/receiver device, and connectors 142*b* are intended to be connected to element feed units 29 of antenna system 10**.

Figure 9:
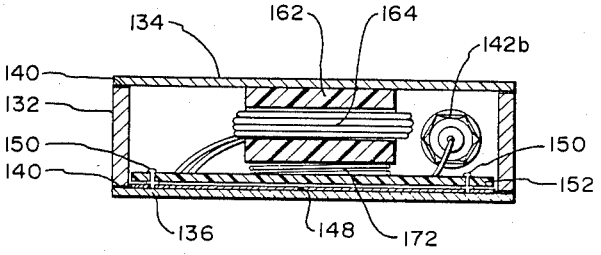
FIG. 9 is a cross-sectional view of the embodiment of the power splitter of FIG. 6 taken along lines 9—9 of FIG. 6.

As depicted in FIG. 9, an insulator board 148 is provided adjacent the bottom 136 of power splitter 130. Insulator board 148 may be formed of any suitable insulation material, such as, for example, fiberglass.

Four supporting pegs 150, which may, for example, be formed of a nylon material, rest on top of insulator board 148. Pegs 150 support a PC board 152 and pass through holes 154 in such PC board (see FIG. 8).

PC board 152 is a double-sided copper-clad PC board. PC board 152 is provided with five contact points 156. As illustrated in FIG. 7, a portion of the copper laminate has been etched away on the top side of PC board 152 around contact point **156*a*, and a channel of the copper laminate has been etched away from the top side of PC board 152 so as to isolate contact point 156*c*. In addition, as depicted in FIG. 8, a portion of the copper laminate surrounding contact points 156*b–e* has been etched away on the bottom side of PC board 152**.

Power splitter 130 is also provided with a ferrite core 162. Ferrite core 162 may be formed of substantially the same materials as the ferrite core 112 of hub 80. Materials suitable for ferrite core 162 may, for example, be obtained from Stackpole as Stock No. 7051 and from Amidon as Stock No. BN-61-7051.

Figure 7A:
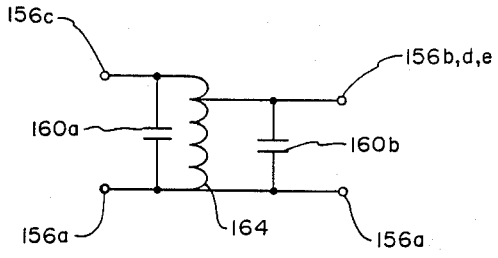
FIG. 7A is an electrical schematic diagram illustrating one presently preferred embodiment of the electrical circuitry of the power splitter of FIG. 6.
Figure 6:
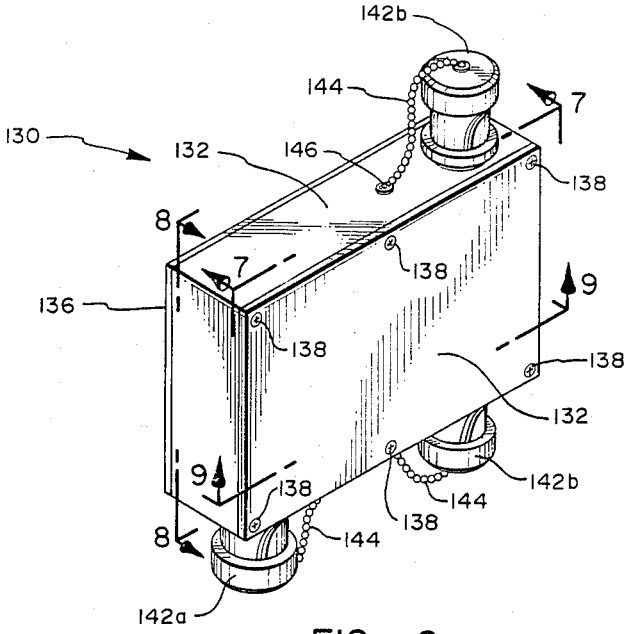
FIG. 6 is a perspective view of one presently preferred embodiment of the power splitter of the antenna system of the present invention.
Figure 7:
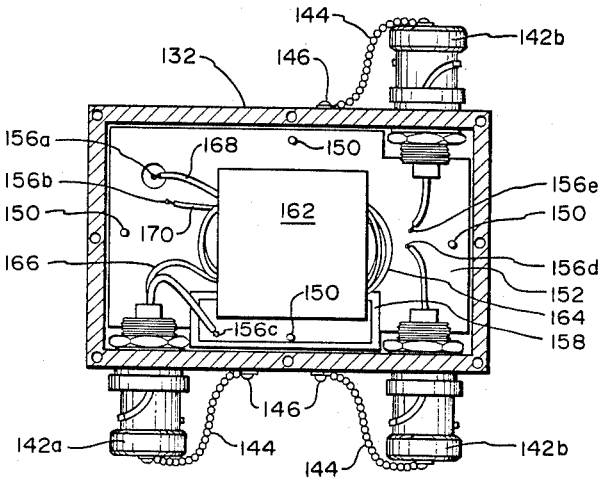
FIG. 7 is a vertical cross-sectional view of the embodiment of the power splitter of FIG. 6 taken along lines 7—7 of FIG. 6.
Figure 8:
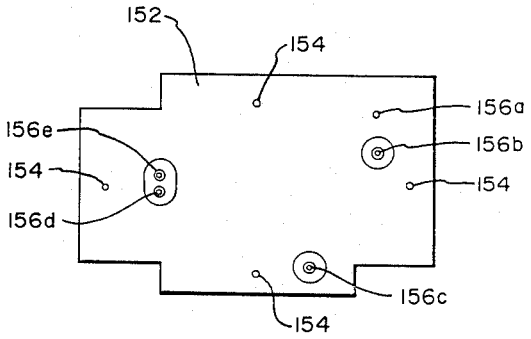
FIG. 8 is a bottom plan view of the printed circuit board of the embodiment of the power splitter of FIG. 6 taken along lines 8—8 of FIG. 6.

FIGS. 7 and 7A illustrate the manner in which the various components of power splitter 130 are connected. As shown, connector **142*a* is connected to the winding 164 of ferrite core 162 through wire 166. The winding 164 of ferrite core 162 is also connected to PC board 152 at contact points 156*a* and 156*b* through wires 168 and 170, respectively. Connectors 142*b* are connected to PC board 152 at contact points 156*d* and 156*e*. As illustrated schematically in FIG. 7A, PC board 152 provides capacitance 160 to the circuitry of power splitter 130**.

Ferrite core 162 may be secured within enclosure 132 of power splitter 130 in any suitable manner. For example, ferrite core 162 may be engaged by a spring 172 which maintains ferrite core in constant tension against the top 134 of enclosure 132. Ferrite core 162 is also coated with a suitable heatsink compound to enhance heat transfer and dissipation between ferrite core 162 and enclosure 132.

The preferred embodiment for power splitter 130 described above is capable of handling 100 watts average power and 200 watts peak power. In addition, it has been found that power splitter 130 operates reliably over a wide range of temperature conditions up to temperatures of approximately 100° C. Further, power splitter 130 gives rise to relatively low insertion losses in the antenna system 10 of the present invention, such insertion losses typically being on the order of approximately 0.1 to approximately 0.5 decibel.

2. Antenna System Operation

When deploying the antenna system 10 of the present invention, power splitter 130 is placed in the center of the area in which antenna system 10 is to be deployed. Reels 30 are removed from element feed units 29 by depressing clips 60 of end caps 50. Then, connectors **142*b* of power splitter 130 are connected to the connector 90 of each element feed unit 29**.

Element feed units 29 may be connected to power splitter 130 using any suitable cable. It is presently preferred that a Teflon® or polyvinyl insulated coaxial cable 16 be used and that element feed units 29 be positioned approximately 20 feet (6 meters) apart.

When connecting element feed units 29 to power splitter 130, the grooves 82 in hubs 80 of element feed units 29 should be on the same side of the connecting cables 16, as depicted in FIG. 10. In this way, the transmitter/receiver device 12 will be able to drive the antenna system 10 in proper phase.

Once element feed units 29 have been positioned and connected to power splitter 130, each clip 60 of each end cap 50 of element feed units 29 is again depressed, and the end loop 34 of each cable 32 is connected around a post 70 of an end cap 50. Cables 32 are then unwound from each of the reels 30, and cables 32 are positioned so as to be substantially parallel to one another, as shown in FIG. 10.

Finally, a transmitter/receiver device 12 is connected by means of a cable 14 to connector **142*a* of power splitter 130. Connecting cable 14 may be formed of the same materials as cables 16. Antenna system 10** is now ready for operation.

The antenna system 10 illustrated in FIG. 10 in its deployed configuration, will transmit or receive signals from stations located less than approximately 300 miles away in any direction. For stations located more than approximately 300 miles away, antenna system 10 will transmit and receive in directions which are substantially parallel to cables 32. Thus, for long distance transmission and reception, one should be sure that antenna system 10 is properly aligned with the transmitting or receiving station.

It is desirable in antenna systems to minimize the amount of radiation which is reflected back along the antenna system to the transmitter/receiver device. A measure of this reflection is the so-called "voltage standing wave ratio" ("VSWR"). The VSWR of an antenna system should preferably be less than approximately 2:1 to avoid undue loss of efficiency.

Figure 11:
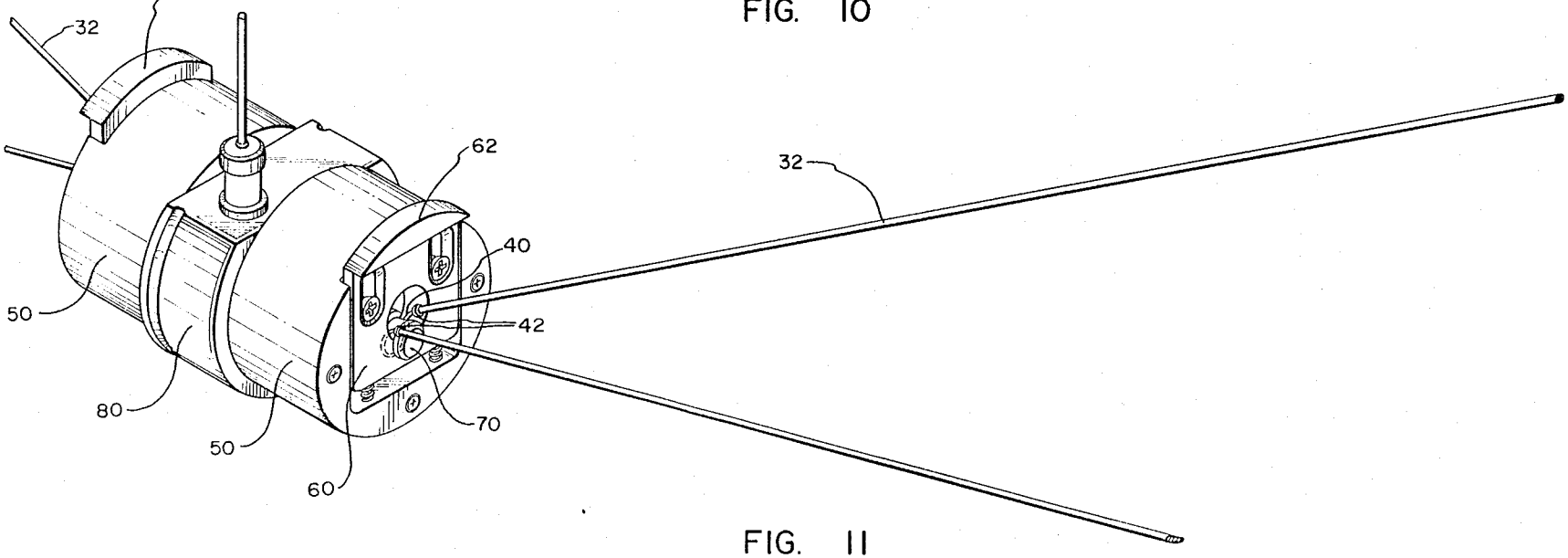
FIG. 11 is a perspective view of an element feed unit within the scope of the present invention illustrating how the cables of the antenna system can be attached to the element feed unit so as to form V-shaped radiating elements.

In order to improve the VSWR of antenna system 10, it may sometimes be desirable to deploy cables 32 in a V-shaped configuration, and to use the system and method for matching the impedance of the antenna to the transmission line as described in copending U.S. application entitled "Broad Band Impedance Matching System and Method for Low-Profile Antennas" filed on Sept. 2, 1986, incorporated herein by reference. For a V-element configuration, as illustrated in FIG. 11, the center portion 40 of each cable 32 is secured around a post 70 in an end cap 50 of element feed units 29. Then, as illustrated in FIG. 12, each cable 32 is extended so as to form a V-shaped configuration. Preferably, the ends of each cable 32 should be positioned no more than approximately 5 feet (1.52 meters) apart. As noted above, the balun (see FIG. 4A) of the hub 80 should have a stepdown ratio ranging preferably from 1:4 to 1:12. It has been found that a VSWR of approximately 1.7:1 can be reliably obtained using the V-element configuration with this procedure for frequencies ranging from 2 to 80 MHz.

Antenna system 10 is somewhat less efficient when it is placed directly upon the surface of the ground. Accordingly, it may be desirable to elevate cables 32 off the ground. Cables 32 should not, however, be elevated a great distance from the ground's surface, and it is presently preferred that cables 32 remain within approximately 2 feet (60.8 centimeters) from the ground.

Accordingly, as depicted in FIG. 12, 23 inch (58.5 centimeter) stakes may be used to support cable 32 along its length. When antenna system 10 is being used over extremely conductive ground, cables 32 may be supported by stakes 18 along their entire length, as illustrated in FIG. 12. In other cases, it is preferred that at least 15 feet (4.56 meters) adjacent each end of cables 32 be placed directly on the ground, as illustrated in FIG. 13.

The antenna system 10 of the present invention is a ground-cooperative antenna of the type disclosed in copending U.S. application Ser. Nos. 393,043, 393,044, and 700,934, incorporated herein by reference. As such, antenna system 10 cooperates with the ground and the surrounding environment to generate its radiation pattern, and may be connected in arrays to further enhance gain and directionality when desired. The radiation pattern of antenna system 10 is generally bidirectional along the antenna's longitudinal axis at low elevation angles. At higher angles, the radiation pattern of antenna system 10 is omnidirectional and has significant radiation intensity at angles of near vertical incidence.

A knowledge of the radiation pattern of antenna system 10 can be used to minimize noise during daytime transmissions over short distances. By orienting antenna system 10 along an east-west axis, noise from electrical storms along the equator can be significantly reduced, since antenna system 10 does not receive significant radiation at low angles in a direction perpendicular to its axis.

If low angle transmissions are particularly important, the low angle directive gain of antenna system 10 can be improved by increasing the length of cables 32. However, as the length of cables 32 increases, the high angle radiation pattern may begin to suffer. Similarly, when transmitting below frequencies of approximately 10 MHz, the directive gain can be improved by increasing the spacing between element feed units 29 of antenna system 10.

3. Summary

From the above discussion, it will be appreciated that the present invention provides a portable broadband antenna system. The antenna system produces significant radiation intensity at angles of near vertical incidence, and the antenna system of the present invention has been found to have satisfactory performance over a frequency range of from approximately 2 MHz to approximately 80 MHz.

The antenna system of the present invention is also portable, rugged, and easily deployed. Since the antenna system is deployed very near to the ground, the antenna system is resistant to destruction and is, therefore, relatively "hard" for security purposes.

Significantly, it has been found that the antenna system of the present invention need not be deployed with great accuracy in order to provide acceptable results. On the contrary, even somewhat casual deployment of antenna system 10 wherein cables 32 may not be extended in a perfectly straight line and/or wherein cables 32 may sag between stakes 18 so as to touch the surface of the ground, antenna system 10 still performs satisfactorily.

The invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A portable roll-out antenna system adapted for rapid deployment and connection to a transmitter/-receiver, said antenna system comprising:

a transmission line connecting at least one antenna cable to said transmitter/receiver;

hub means comprising means for matching the impedance of said antenna cable to the impedance of said transmission line;

at least one reel means for selectively unwinding said antenna cable when said antenna system is deployed, said reel means being mounted onto said hub means to form a unitary, compact, portable assembly when said antenna cable is wound onto said reel means; and clip means for releasably securing said reel means on said hub means when mounted thereon, said clip means comprising connector means electrically connected to said means for matching impedance, and said connector means being releasably connected to said antenna cable.

2. An antenna system as defined in claim 1 wherein said means for matching impedance comprises an RF transformer connected between said transmission line and said antenna cable having an impedance stepdown ratio ranging from approximately 1:4 to approximately 1:12.

3. An antenna system as defined in claim 1 wherein said reel means comprises two reels each having an antenna cable wound thereon, and wherein said hub means comprises a pair of end caps mounted on opposite sides of said hub means, each end cap comprising means for receiving one of said reels for mounting thereon, and wherein said clip means comprises a retaining clip attached to each said end cap.

4. An antenna system as defined in claim 1 wherein said hub means comprises an end cap mounted on a side of said hub means, said end cap comprising means for receiving said reel means for mounting thereon, and wherein said clip means comprises a retaining clip attached to an end of said end cap.

5. An antenna system as defined in claims 3 or 4 wherein each said end cap comprises a slot open at one end adapted to receive a retaining clip in sliding engagement with said slot, and means for biasing said retaining clip such that an edge of said retaining clip is urged to protrude beyond said open end of the slot so as to form a shoulder for securing said reel means on said end cap, said retaining clip being movable in said slot so as to release said reel means when it is desired to deploy said antenna cable.

6. An antenna system as defined in claims 3 or 4 wherein said connector means comprises a connector post electrically connected to said means for matching impedance, and wherein each said retaining clip has a notched opening formed therethrough adapted to receive said connector post such that when said clip is in said biased position, said post is secured in said notched opening, whereby said antenna cable may be electrically connected and held fast to said connector post when the post is secured in said notched opening.

7. An antenna system as defined in claim 3 further comprising a lightweight, portable power splitter and wherein said hub means further comprises means for electrically connecting said power splitter to said means for matching impedance.

8. An antenna system as defined in claim 1 further comprising a plurality of stakes for supporting at least a portion of said antenna cable off of but in proximity to the ground.

9. A portable, light-weight, low-profile, broadband ground-cooperative antenna system adapted for rapid deployment and connection to a transmitter/receiver, said antenna system comprising:

a transmission line connecting at least one antenna cable to said transmitter/receiver;

hub means comprising means for matching the impedance of said antenna cable to the impedance of said transmission line;

at least one reel means for selectively unwinding said antenna cable so as to be able to deploy said antenna cable in proximity to the ground such that the radiation pattern of said antenna cable is generally bidirectional along a longitudinal axis at low elevation angles, and is omnidirectional at angles of near vertical incidence, said reel means being mounted onto said hub means to form a unitary, compact, portable assembly when said antenna cable is wound onto said reel means;

clip means for releasably securing said reel means on said hub means when mounted thereon, said clip means comprising connector means electrically connected to said means for matching impedance, and said connector means being releasably connected to said antenna cable; and wherein said means for matching impedance is selected so as to maintain a VSWR of less than approximately 2:1 over a range of at least two octaves of frequencies selected from the LF to VHF range.

10. An antenna system as defined in claim 9 wherein said means for matching impedance comprises a balun connected between said transmission line and said antenna cable having an impedance stepdown ratio ranging from approximately 1:4 to approximately 1:12.

11. An antenna system as defined in claim 9 wherein said hub means comprises an end cap mounted on a side of said hub means, said end cap comprising means for receiving said reel means for mounting thereon, and wherein said clip means comprises a retaining clip attached to an end of said end cap.

12. An antenna system as defined in claim 9 wherein said reel means comprises two reels each having an antenna cable wound thereon, and wherein said hub means comprises a pair of end caps mounted on opposite sides of said hub means, each end cap comprising means for receiving one of said reels for mounting thereon, and wherein said clip means comprises a retaining clip attached to each said end cap.

13. An antenna system as defined in claims 11 or 12 wherein each said end cap comprises a slot open at one end adapted to receive a retaining clip in sliding engagement with said slot, and means for biasing said retaining clip such that an edge of said retaining clip is urged to protrude beyond said open end of the slot so as to form a shoulder for securing said reel means on said end cap, said retaining clip being movable in said slot so as to release said reel means when it is desired to deploy said antenna cable.

14. An antenna system as defined in claims 11 or 12 wherein said connector means comprises a connector post electrically connected to said means for matching impedance, and wherein each said retaining clip has a notched opening formed therethrough adapted to receive said connector post such that when said clip is in said biased position, said post is secured in said notched opening, whereby said antenna cable may be electrically connected and held fast to said connector post when the post is secured in said notched opening.

15. An antenna system as defined in claim 12 further comprising a lightweight, portable power splitter and wherein said hub means further comprises means for electrically connecting said power splitter to said means for matching impedance.

16. An antenna system as defined in claim 9 further comprising a plurality of stakes for supporting at least a portion of said antenna cable off of but in proximity to the ground.

17. A portable roll-out antenna system adapted for rapid deployment and connection to a transmitter/-receiver, said antenna system comprising:

at least two flexible antenna cables that are unwound when it is desired to deploy said antenna cables;

a transmission line electrically connecting said antenna cables to said transmitter/receiver;

hub means comprising means for matching the impedance of said antenna cables to the impedance of said transmission line;

first and second reel means on which said antenna cables are wound and from which said antenna cables are selectively unwound when deployed, each said reel means being mounted onto said hub means to form a unitary, compact, portable assembly when said antenna cables are wound onto said reel means; and first and second clip means for releasably securing each said reel means on said hub means when mounted thereon, each said clip means comprising connector means electrially connected to said means for matching impedance, and each said connector means being releasably connected to one of said antenna cables.

18. An antenna system as defined in claim 17 wherein said hub means comprises a pair of end caps mounted on opposite sides of said hub means, each said end cap comprising means for receiving one of said reel means for mounting thereon, and each said end cap having a slot open at one end, and wherein each said clip means comprises a retaining clip adapted to slidingly engage said slot.

19. An antenna system as defined in claim 18 further comprising means for biasing each said retaining clip such that an edge of said retaining clip is urged to protrude beyond said open end of the slot so as to form a shoulder for securing one of the reel means on a corresponding end cap, each said retaining clip being slidable in its corresponding slot so as to release said reel means when it is desired to unwind the antenna cable wound thereon.

20. An antenna system as defined in claim 19 wherein each said connector means comprises a connector post electrically connected to said means for matching impedance, and wherein each retaining clip has a notched opening formed therethrough adapted to receive said connector post such that when said clip is in said biased position, said post is secured in said notched opening, whereby one of said antenna cables may be electrically connected and held fast to said connector post when the post is secured in said notched opening.

21. A portable, light-weight, low-profile, broadband ground-cooperative antenna system adapted for rapid deployment and connection to a transmitter/receiver, said antenna system comprising:

a transmission line connecting at least one antenna cable to said transmitter/receiver;

hub means comprising means for matching the impedance of said antenna cable to the impedance of said transmission line;

at least one reel means for selectively unwinding said antenna cable so as to be able to deploy said antenna cable in proximity to the ground such that the radiation pattern of said antenna cable is generally bidirectional along a longitudinal axis at low elevation angles, and is omnidirectional at angles of near vertical incidence, said reel means being mounted onto said hub means to form a unitary, compact, portable assembly when said antenna cable is wound onto said reel means; and wherein said means for matching impedance is selected so as to maintain a VSWR of less than approximately 2:1 over a range of at least two octaves of frequencies selected from the LF to VHF range.

* * * * *